US006952844B2

(12) United States Patent
Danaher

(10) Patent No.: US 6,952,844 B2
(45) Date of Patent: Oct. 11, 2005

(54) BED-TENT

(76) Inventor: Thomas C. Danaher, 484 W. 43rd St., Rm 42-5, New York, NY (US) 10036

( * ) Notice: Subject to any disclaimer, the term of this patent is extended or adjusted under 35 U.S.C. 154(b) by 0 days.

(21) Appl. No.: 10/649,036

(22) Filed: Aug. 27, 2003

(65) Prior Publication Data

US 2005/0044630 A1 Mar. 3, 2005

(51) Int. Cl.[7] ..... A47C 29/00; E04H 15/02; E04H 15/40; E04H 15/42

(52) U.S. Cl. ..... 5/414; 135/96; 135/156; 135/127; 135/137

(58) Field of Search ..... 5/414, 113, 424, 5/658; 135/96, 156, 125–128, 137, 138, 143, 116, 119, 906

(56) References Cited

U.S. PATENT DOCUMENTS

| | | | | | |
|---|---|---|---|---|---|
| 1,608,242 | A | | 11/1926 | Sava | |
| 2,357,056 | A | * | 8/1944 | Nelson | 135/137 |
| 2,367,043 | A | * | 1/1945 | Nelson | 135/120.3 |
| 2,646,057 | A | * | 7/1953 | Blanchard | 135/94 |
| 2,961,802 | A | * | 11/1960 | Mongan et al. | 52/81.4 |
| 2,963,030 | A | * | 12/1960 | Blanchard | 135/123 |
| 3,168,101 | A | * | 2/1965 | Porter | 135/156 |
| 3,278,953 | A | * | 10/1966 | Willis | 5/113 |
| 3,454,021 | A | * | 7/1969 | Morris | 135/156 |
| 3,474,802 | A | | 10/1969 | Loring | |
| 3,601,825 | A | * | 8/1971 | Moorhead et al. | 5/110 |
| 3,619,827 | A | * | 11/1971 | Mackenzie | 5/113 |
| 3,665,944 | A | | 5/1972 | Knapp | |
| 3,800,468 | A | | 4/1974 | DeGraff | |
| 3,800,814 | A | | 4/1974 | Hibbert | |
| 3,814,058 | A | * | 6/1974 | Thompson | 119/482 |
| 3,848,279 | A | * | 11/1974 | Ipsen, Jr. | 5/113 |
| 3,848,615 | A | | 11/1974 | Warner et al. | |
| 3,886,609 | A | * | 6/1975 | MacKenzie | 5/110 |
| 3,929,145 | A | | 12/1975 | Schroeder | |
| 3,943,953 | A | * | 3/1976 | Cantwell et al. | 135/156 |
| 3,951,159 | A | * | 4/1976 | Robinson et al. | 135/142 |
| 3,960,161 | A | | 6/1976 | Norman | |
| 3,970,096 | A | | 7/1976 | Nicolai | |
| 3,990,463 | A | | 11/1976 | Norman | |
| 4,003,181 | A | * | 1/1977 | Robinson et al. | 135/115 |
| 4,193,413 | A | * | 3/1980 | Watts et al. | 135/98 |

(Continued)

FOREIGN PATENT DOCUMENTS

| | | |
|---|---|---|
| AU | 49503/72 | 6/1974 |
| FR | 2640669 | 6/1990 |

OTHER PUBLICATIONS

CAMPMOR—Spring 1995, pp. 1 and 15.
QUICKDRAW—Quickdraw Pop up Style Self Erecting Tents, pp. 2–5.

*Primary Examiner*—Robert G. Santos
(74) *Attorney, Agent, or Firm*—Reising, Ethington, Barnes, Kisselle, P.C.

(57) ABSTRACT

A bed-tent provides an enclosure over a mattress. The tent forms a canopy having spaced apart panels and a flexible cover extending between the panels. Each panel includes a hoop of flexible, resilient, strip material and a sheet of flexible fabric in the space within the hoop. Retainers secure the canopy on the mattress. A supporting frame holds the panels erect. The frame has stanchions disposed externally of the canopy and releasably connected to the panels. A frame member externally of the canopy above the cover holds the stanchions upright. The hoops can be twisted or wound into flat coils of reduced diameter so that the entire canopy can be conveniently stored in a small package. The legs and the frame member are made of segments that are normally held together by elastic cords. The segments can be pulled apart and separated for storage in a convenient package.

28 Claims, 8 Drawing Sheets

U.S. PATENT DOCUMENTS 4,195,651 A * 4/1980 Watts et al. ..... 135/135
4,285,355 A * 8/1981 Lundblade ..... 135/147
4,531,330 A * 7/1985 Phillips ..... 52/2.21
4,569,362 A 2/1986 Fidler, Jr.
4,590,956 A 5/1986 Griesenback
4,682,436 A 7/1987 Ritson
4,815,784 A 3/1989 Zheng
4,825,578 A 5/1989 Robinson
4,825,892 A 5/1989 Norman
4,827,958 A * 5/1989 Cantwell et al. ..... 135/127
4,846,204 A * 7/1989 Sok Kyu ..... 5/113
4,846,205 A 7/1989 Knoll
4,852,598 A 8/1989 Griesenback
4,858,634 A 8/1989 McLeese
4,914,768 A * 4/1990 Howard ..... 5/113
4,979,531 A 12/1990 Toor et al.
5,018,227 A * 5/1991 Canfield ..... 5/113
5,029,847 A 7/1991 Ross
5,031,652 A 7/1991 Lester
5,072,694 A * 12/1991 Haynes et al. ..... 119/482
5,137,044 A 8/1992 Brady
5,163,461 A 11/1992 Ivanovich
5,210,888 A * 5/1993 Canfield ..... 5/113
5,261,436 A * 11/1993 Funk ..... 135/156
5,343,887 A 9/1994 Danaher
5,452,934 A 9/1995 Zheng
5,467,794 A 11/1995 Zheng
5,517,707 A 5/1996 La Mantia
D372,953 S * 8/1996 Florez ..... D21/838
5,638,848 A * 6/1997 November ..... 135/90
5,676,168 A 10/1997 Price
5,685,076 A 11/1997 Curley
5,778,915 A 7/1998 Zheng
6,032,685 A 3/2000 Zheng
6,098,218 A * 8/2000 Ventura ..... 5/113
6,109,282 A 8/2000 Yoon
6,138,701 A 10/2000 Zheng
6,305,396 B1 10/2001 Zheng
6,360,761 B1 3/2002 Zheng
6,363,955 B1 4/2002 Louie
6,491,052 B1 12/2002 Zheng
6,502,596 B1 * 1/2003 Danaher ..... 135/126
6,644,329 B2 * 11/2003 Tomason ..... 135/96
2005/0044630 A1 * 3/2005 Danaher ..... 5/414

* cited by examiner

BED-TENT

TECHNICAL FIELD

Portable tents are well-known and can be used for many different purposes. This invention relates to tents adaptable for indoor use. More particularly, the tent of this invention incorporates a bottom portion adapted to be fitted over a conventional bed mattress. Known in the prior art as a bed-tent, this embodiment is especially popular for use as a children's toy.

BACKGROUND AND SUMMARY

All prior art bed-tents consist of some sort of a fabric-covered pole structure which rests on the top surface of a conventional bed mattress. Prior art bed-tents utilize semi-rigid, bowed poles which place the cover or canopy under tension; the tension is provided by bending the support poles and securing them with a canopy which is attached to the mattress. Bed-tents have enjoyed commercial success but have always presented problems of various types.

One of the principal problems with prior art bed-tents is that associated with erecting them as the user must be familiar with an exacting set-up procedure. The process begins with unpacking a folded stack of segmented poles and an enormous, bewildering canopy; the finished set-up shape is completely unrecognizable. Prior art bed-tents require the poles and canopy to be assembled simultaneously: poles of different lengths are threaded through a series of fabric sleeves or the like attached to part of the canopy. Choosing the correct pole for the correct sleeve makes this an unforgiving process and only after the last pole is wrestled into place does the bed-tent neaten and its shape finally become apparent. It is no surprise that the instruction manuals for prior art bed-tents caution, "Adult assembly required."

Further complicating the set-up procedure, all prior art bed-tents place the flexible poles inside the canopy, where access is limited during set-up and assembly. Original bed-tent U.S. Pat. No. 4,852,598 describes, "elongated flexible frame members adapted to support said canopy means over said mattress when positioned between said top surface of said mattress and said canopy means." Erecting such bed-tents requires adults to climb inside the partially supported, quavering canopy while securing the internal pole structure in an exact position. As most adults cannot fit inside prior art bed-tents, which are designed to attach to a child's twin size mattress, the torments above are greatly multiplied.

Ease of set-up is a crucial consideration for adults purchasing toys such as a bed-tent. In short, parents generally will not tolerate difficult or time-consuming assembly of toy products and frequently return a product to the retailer if assembly is complex. Present day bed-tents suffer the conspicuous liability of an extraordinarily high returns percentage. Most bed-tents are currently sold through mail-order outlets which offer generous return privileges; traditional retailers no longer distribute the prior art product.

Attempts have been made to simplify the task of erecting the bed-tent. U.S. Pat. No. 4,590,956 proved too difficult to assemble because of an integrated canopy and fitted sheet which attached to the mattress. U.S. Pat. No. 4,852,598 eliminated the integral fitted sheet and thus simplified the set-up procedure but only to a small degree.

The Bed-Tent of My Invention

My invention eliminates the internal frame assembly of the prior art. The preferred embodiments instead utilize a flexible, resilient strip material induced by a non-stretch fabric to form a weight-bearing hoop. By itself the hoop sags and offers no support, however because the hoop is secured at generally all points of its perimeter by an attached non-stretch fabric, it can bear considerable weight. The fabric-covered hoop may incorporate openings for doors and/or windows and still retain its weight-bearing feature. The hoop of my invention is circular, oval; arch shaped; or generally square, rectangular or triangular with acute or truncated corners; elliptical or "saddle-shape" (a combination of two arches). These forms are well-known to those skilled in the architectural arts to disperse weight evenly and with great stability. The strip material may be made of plastic, metal, composite or the like and can be collapsed by turning or twisting into a packed generally flat disk. The hoop may be connected permanently or removably attached and reinserted to allow washing of the canopy. It may also include a coupling means that permits the abutting ends of the strip material to rotate with respect to each other to simplify the collapsing process. It should be noted that differently-shaped hoops can be twisted and collapsed as if they were plain hoops. The hoop connects to a canopy to form an enclosure; the canopy is releasably attached to a mattress by elastic bands or the like.

The first preferred embodiment of my invention utilizes two collapsible oval hoops which constitute opposite end panels of the structure and a flexible canopy between them. The hoops of this embodiment are constricted by a non-stretch fabric generally in the plane of the hoop and are collapsed by folding as described in the accompanying drawings. The end panels are releasably connected above the mattress to a pole assembly or frame made of PVC plastic, fiberglass or the like. The embodiments of my invention which utilize collapsible hoops and a pole assembly may place the frame inside or outside of the canopy; this first preferred embodiment utilizes an external frame to provide full visibility and accessibility while assembling and disassembling the structure.

In other first preferred embodiments, the resilient strip is open-ended and is induced by the fabric into an arch shape rather than a closed annulus. The bed-tent of this embodiment therefore utilizes two collapsible arches which constitute the opposite end panels and releasably attach to a pole assembly or frame. The open-ended strip collapses by holding the ends together before folding or by winding the hoop into a smaller spiral as described in the accompanying drawings.

Still further first preferred embodiments eliminate the resilient strip and instead utilize semi-rigid members made of plastic, fiberglass, metal or the like. For example, the above-mentioned ovals may be made from semi-rigid material to constitute the opposite end panels of a structure. Similarly, the above-mentioned arch may be made from semi-rigid material to constitute the end panel. Further, the semi-rigid material may be a unitary piece or of segmented pieces; segmented pieces are shorter and may be joined by an elastomeric cord for convenience when folding or they may be telescopic so one segment slides into another for storage. The ends also may be attached to each other by a hinge mechanism which straightens in use and folds for storage. Semi-rigid pieces can be utilized as frame members in the manner of prior bed-tent U.S. Pat. No. 4,852,598 without compromising the objects of this invention; the pole assembly of these embodiments is positioned outside the canopy for ease of assembly and disassembly.

The second preferred embodiment eliminates the pole assembly and the fabric within the plane of the hoop.

Instead, the resilient, strip material is induced into an oval or saddle-shaped supporting member by a fabric channel permanently affixed to the canopy of the structure. One embodiment requires only a single strip of flexible material inside a constricting channel. A further embodiment utilizes a single continuous strip formed to comprise a "figure 8" arrangement with two closed hoops. Other embodiments provide increased stability by utilizing two or three resilient strips inside the same or generally separate fabric channels; the hoops of these embodiments may be made from a continuous piece of strip material or from separate pieces. The second preferred embodiment is easiest to assemble as the frame is eliminated and the hoop(s) pops open to form an essentially self-erecting bed-tent. However, this embodiment is more limited than others in terms of the numbers of possible bed-tent shapes. The second preferred invention also necessitates attachment of the canopy to the mattress to provide the required stability.

The third preferred embodiment also eliminates the pole assembly by providing four panels which form the sides of the structure. The panels of this embodiment incorporate at least one hoop, and a non-stretch fabric preferably in the general plane of the hoop as in the first preferred embodiment. In one embodiment a large hoop is incorporated within each of two opposite side panels and a small hoop within each of two opposite end panels to form the four supported sides of the bed-tent.

Another embodiment substitutes two or more small fabric-covered hoops in generally the same plane for a single, large hoop. The hoops of this embodiment may be formed from a single, continuous strip to comprise a "figure 8" arrangement as described previously. The "figure 8" can hinge at its midpoint to turn the corner of the mattress and thus provide for two sides or portions of two sides of the bed-tent. Closed hoops formed from separate or the same resilient strip material may be located on top of each other or secured to each other along a limited perimeter thereof to provide for stronger panels. In a further non-limiting example, closed hoops formed from separate resilient strips can be adjoining or spaced apart and connected by an interconnecting piece of fabric which is part of the panel. To facilitate folding of these structures, the panels may be releasably coupled to each other by Velcro, buttons, snap-fit engagements or ties as is common in the prior art. A flexible fabric forms the roof to provide an enclosed interior space.

Accordingly, several advantages and benefits of the present invention are described hereinafter.

Easier Assembly

The bed-tent of my invention is uniquely easy to assemble. When shaken by the user, the collapsed hoop pops open and virtually self erects; the structure's finished set-up shape is immediately recognizable. The canopy attaches by elastic bands or the like to the mattress in a manner common to the bedding industry. The first preferred bed-tent utilizes a pole assembly located outside the structure and connected to the canopy by clips or the like in an essentially intuitive process. The bed-tent of my invention can be easily assembled by a novice or first-time user; there is no "adult assembly required." To disassemble the bed-tent, the assembly process is reversed and the resilient strip(s) collapsed by folding or winding as described in the accompanying drawings.

Myriad Shapes Possible

My invention markedly expands the range of operable bed-tent shapes by providing for increased adaptability of the structure's framing members. The pole assembly of the first preferred embodiment is outside the canopy so it is accessible and convenient to attach additional frame members for aesthetic or semi-functional purposes with minimal expense. For example, frame members can be added to support extensions to the canopy such as awnings, verandas, vestibules or covered windows. Elements such as wings, fins or the like can be added to increase aesthetic options. A significant advantage of my invention in the crowded field of children's toys is the enormous flexibility in terms of the number of possible new shapes and designs. Finally, the bed-tent of my invention can easily be enlarged for larger mattresses without compromising the objects of my invention. Embodiments for bigger mattresses can be adapted and netting material used, for example, to provide adults bug-free environments. Enlarging the canopy and the pole assembly, and/or increasing the size or number of the hoop(s) provides for structures fitting full, queen, king and California king size beds, among others.

Fewer Parts

Prior art bed-tent structures required as many as seven separate rods or at least two framing assemblies and the independent canopy. Embodiments of my invention eliminating the pole assembly utilize integrated fabric-covered hoops to provide for an essentially one-piece structure. Other embodiments utilizing pole assemblies include a single pole assembly made from a unitary or interconnected segmented pieces to provide for an essentially two-piece structure. In addition to using fewer parts, my invention reduces the possibility of lost parts.

Speedier Assembly

A crucial improvement to the first preferred embodiment of my invention is that the frame may be assembled independently of the canopy. The single segmented frame assembly snaps together rapidly via an internal tension cord and the hoops pop open instantly and are connected to the frame. The canopy quickly attaches to the hoops with clips and to the mattress with a few elastic bands. Other bed-tent embodiments eliminating the pole assembly require only the integrated fabric-covered hoops to be popped open before attachment to the mattress. Adults and especially children will appreciate the increased speed in erecting their bed-tents.

Safety

A still further improvement of my bed-tent is safety. Prior art bed-tents, which secured the poles inside the canopy with fabric ties and the like, posed a potential hazard of a child's entanglement with the framing members. Such members of my present invention are located either outside of, or integrated within the fabric canopy. The preferred embodiment utilizes a pole assembly outside the canopy connected by an internally mounted low tension elastomeric cord anchored out of harm's way inside the tips of the frame structure. The pole assemblies of my invention bend readily; they can be flattened all the way to the mattress and recover to their original position. The flexible strip(s) forming the hoops or arch bend to absorb stress from any direction without breakage. It is impossible for a child inside the bed-tent of my invention to have access to the elastic straps which secure the bed-tent to the mattress. Further, my bed-tent's structure and attachment means are designed to remain secured to the mattress despite considerable lateral force applied against them. A surprising and unexpected result is that my invention can actually catch and hold a small child who might otherwise fall to the floor. A larger child's fall can be slowed and impact lessened. While especially effective when closed, a partially opened bed-tent of my invention can also perform this important function. Finally, the bed-tent of my invention has no small parts that can be mistakenly swallowed by a child.

Easy to Use

All embodiments of my bed-tent rest on an approximately rectangular or oval shaped open base attached to the mattress. The open base and attachment means enable the bed-tent to fit over a child's favorite bedding; no specialized sheets, blankets, etc., are required. Removal of sheets or blankets is not necessary for assembly or disassembly of the structure. Bedding, including fitted sheets, can be neatened in the normal manner. Further, the vertical sidewalls of the preferred embodiment provide for full utilization of the top of the mattress so pillows, blankets and toys may be pushed all the way to the edge of the structure. Finally, the preferred embodiment of my invention provides a consistent height throughout the entire length of the bed-tent to maximize the internal space.

Less Expensive

Nature's most efficient shape (maximum internal area with minimum surface area) is a circle. Due to the generally circular shape of my preferred bed-tent structure, my invention encloses more living space per given amount of fabric than any prior art bed-tent. Putting this another way, to provide a structure of given internal living space, the bed-tent of my invention requires less fabric. The consistent height of my preferred embodiment also eliminates fabric waste as full widths of material can be utilized. Further, my invention eliminates the apex common to all prior art bed-tents so costly workmanship to cut and sew irregular fabric patterns is minimized. Finally, my invention eliminates the obvious disadvantage of breakage suffered by prior art bed-tents which are ruined if a single frame member fails. Present-day bed-tent manufacturers employ costly service departments which serve primarily to replace broken frame members.

Portable

All embodiments of my invention fold into a compact flat disc. Embodiments utilizing a segmented pole assembly may be folded into a small bundle as common in the prior art. Weight of the packed bed-tent is evenly balanced for ease of transport. Containerizing, shipping and insurance costs are correspondingly reduced.

The features, advantages and objects of my invention, which are explicit and implicit in the foregoing, as well as others, will become apparent and more fully understood from the following description of the invention made in connection with the accompanying drawings.

DETAILED DESCRIPTION OF THE PREFERRED EMBODIMENTS

Figure 1:
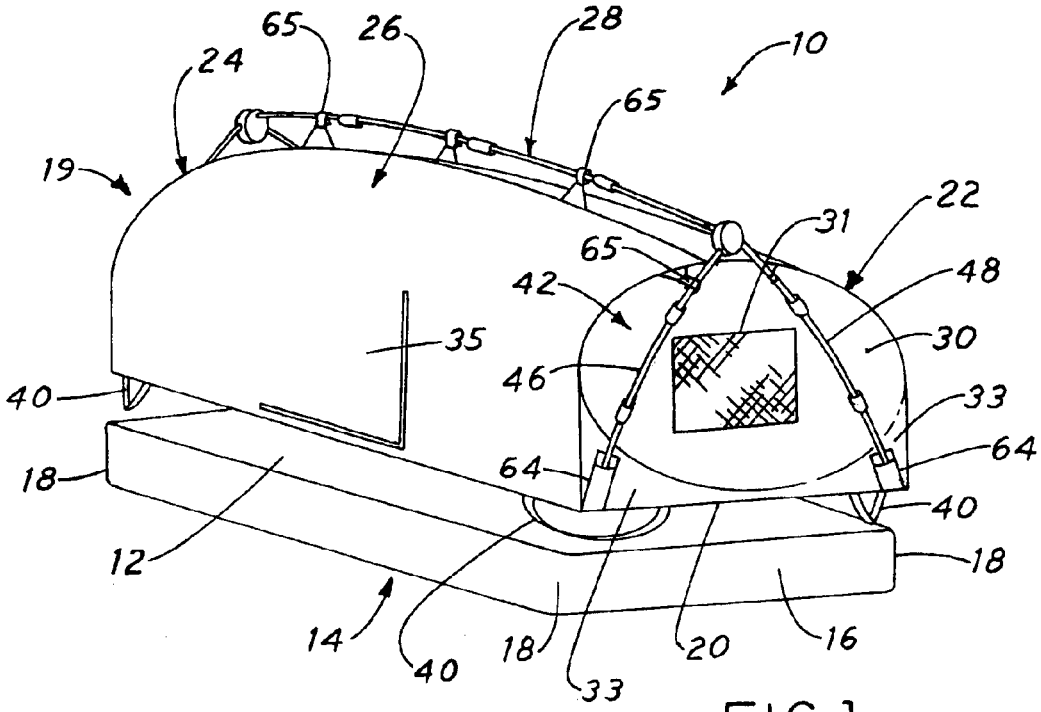
FIG. 1 is a perspective view of a bed-tent including a canopy and a supporting frame, constructed in accordance with the invention and shown positioned over a mattress in preparation for mounting the bed-tent on the mattress.
Figure 2:
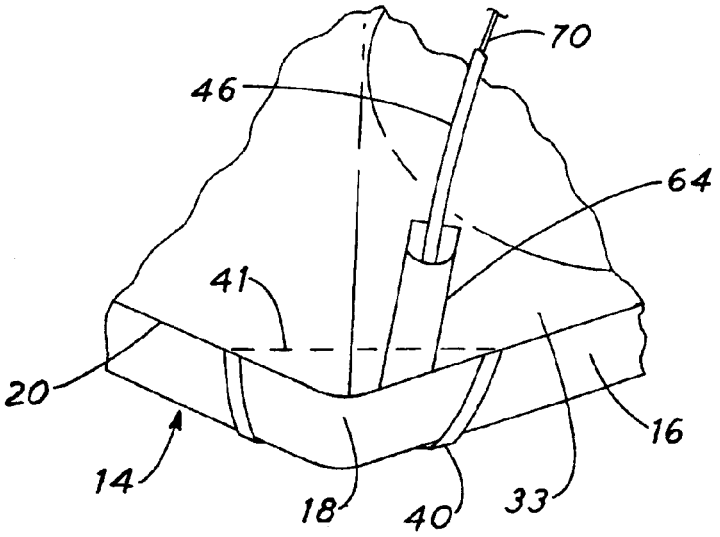
FIG. 2 is an enlarged perspective view showing a corner of the canopy attached to the mattress.
Figure 3:
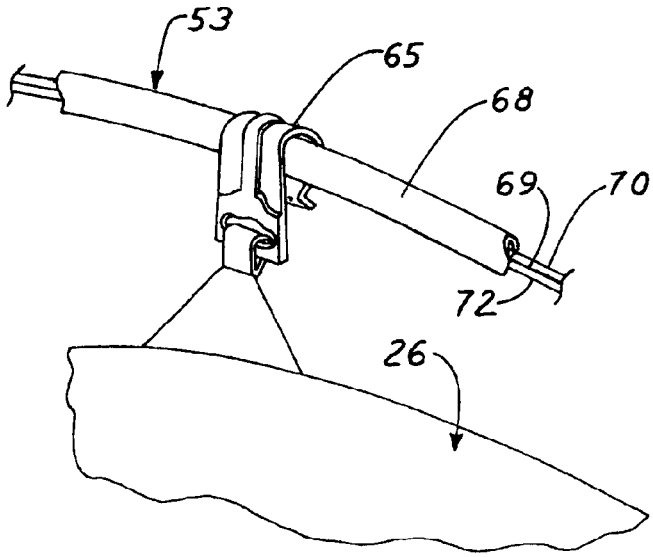
FIG. 3 is an enlarged fragmentary perspective view of a portion of FIG. 1 showing clips attaching the canopy to a portion of the supporting frame.

Referring now more particularly to the drawings, and especially FIGS. 1 and 2, there is shown a bed-tent 10 for sheltering at least one person. The bed-tent 10 is shown disposed over the top surface 12 of a mattress 14 of a bed, prior to being mounted thereon. The mattress 14 is preferably of the usual rectangular shape, having a peripheral edge 16 and four corners 18. The bed-tent 10 is intended to be occupied by one child, although more than one child may occupy the bed-tent if desired and if permitted by a supervising adult.

The bed-tent 10 comprises a canopy 19 having an open base 20 generally co-extensive with the peripheral edge 16 of the mattress. The canopy has end panels 22 and 24, and a flexible fabric cover 26. A supporting frame 28 holds the end panels in longitudinally spaced, generally upright position.

Figure 4:
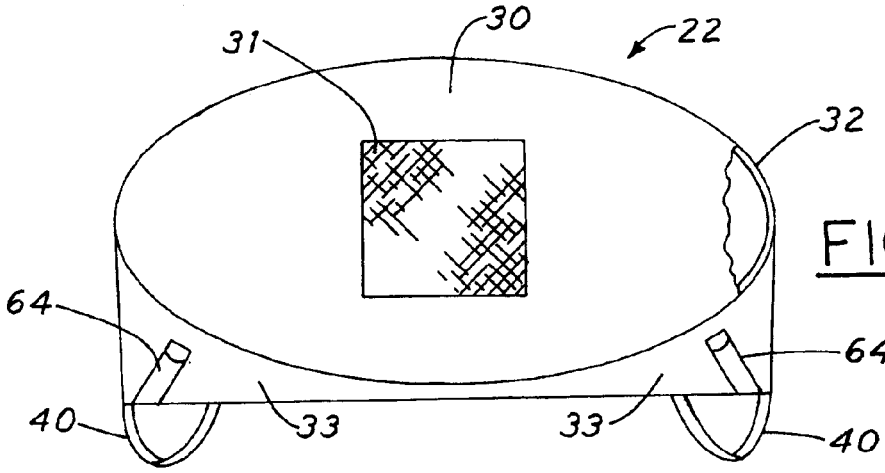
FIG. 4 is an end view of the canopy, showing one end panel thereof in which parts are broken away. The end panel at the opposite end of the canopy is exactly like to end panel shown.
Figure 5:
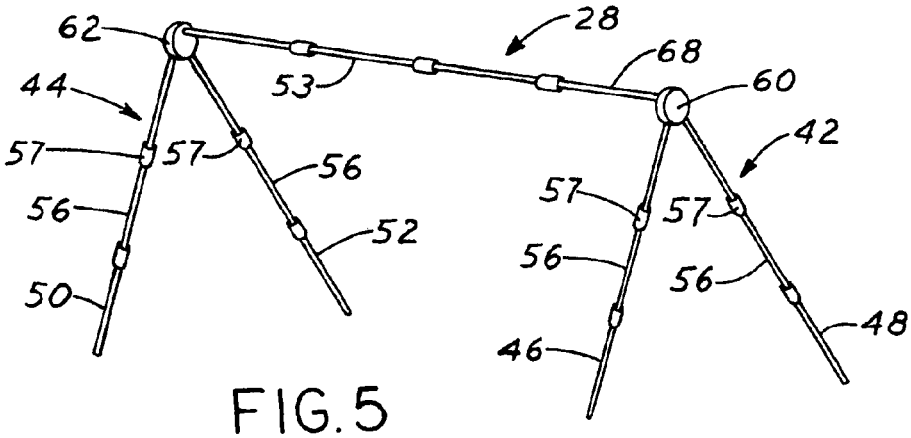
FIG. 5 is a perspective view of the supporting frame.
Figure 6:
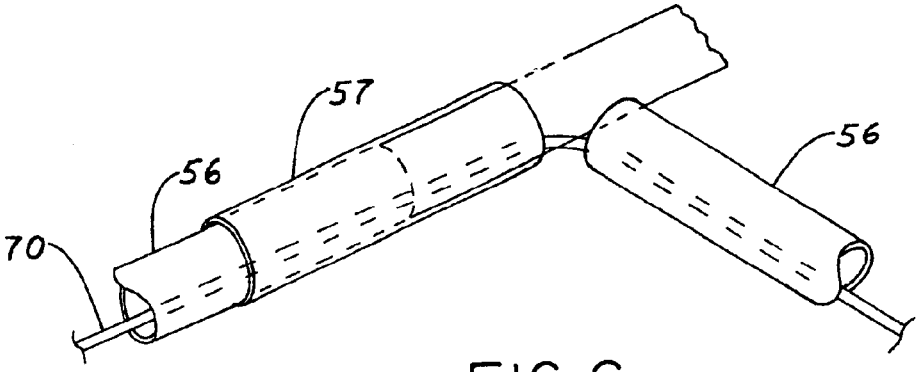
FIG. 6 is a fragmentary perspective view showing two segments of a leg of the supporting frame separated from one another.
Figure 7:
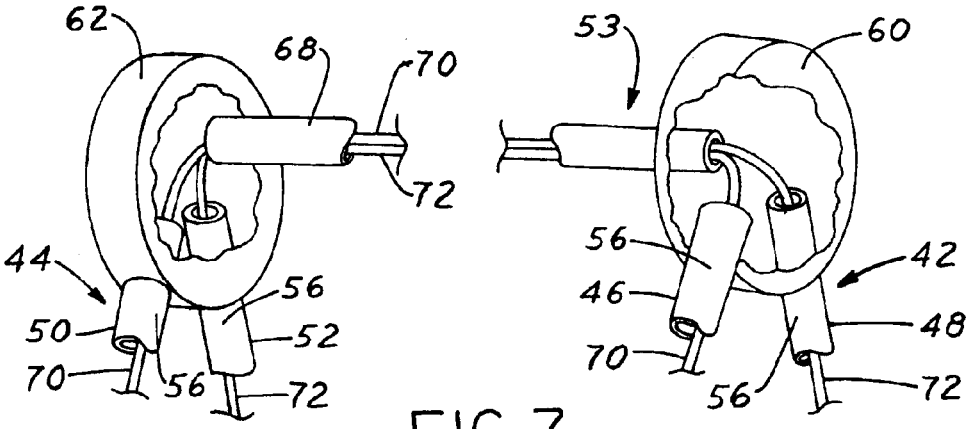
FIG. 7 is a fragmentary perspective view of portions of the supporting frame.

The end panels 22 and 24 are preferably of identical construction, each comprising a sheet 30 of substantially non-stretchable flexible fabric and a framing member in the form of hoop 32 of flexible, resilient strip material such as spring steel, composite rod or plastic, for example. Each hoop may be a continuous annulus or it may be transversely split with abutting ends at the split or open-ended to provide for an arch shape hoop (not shown). The hoops may be circular throughout a full 360° or they may be other than circular as by being of oval shape as shown in FIG. 4. Not shown are further shapes including circles or ovals incorporating one square corner, two square corners (a continuous arch annulus), triangular, approximately square or rectangular; the corners of these versions may be curved or acute. The hoops of each end panel preferably are disposed in the plane of the sheet 30 and are secured to the outer edge of the sheet, as by folding the outer edge over the hoop and stitching the folded-over outer edge to the sheet. For additional strength a second hoop of strip material (not shown) can be secured to the outer edge of the sheet. The first and second hoops can be formed of a single unitary piece of strip material. Finally, this second hoop can be adapted to be secured to the first hoop along a limited periphery thereof (not shown). The portion of the sheets 30 within each hoop 32 is held taut by the hoop and resists distortion or collapse of the hoop. A screened window opening 31 is provided in the sheet 30 of at least one end panel.

The cover 26 is made of substantially non-stretchable, flexible fabric and extends between the end panels 22 and 24. The cover 26 is held fairly taut by having its ends stitched or otherwise secured to the margins of the end panels as by a zipper, for example and to the side edges of extensions 33 of the sheets 30. The cover 26 defines the sides and top of the canopy. One side of the cover 26 has a cut away portion providing a flap 35 that may be folded back to form an opening for access to the interior of the canopy. The flap serves as a closure for the opening when extended across the opening and held shut by a zipper or other fastening device.

Two flexible retainers, preferably in the form of elastic straps 40 are secured to extensions 33 of the sheet 30 of each end panel 22, 24. The straps 40 are adapted to be extended over the four corners of the mattress 14 to hold the tent on the mattress. The four corners of the bed-tent preferably have pads or triangular fabric pieces 41 stitched or otherwise secured to the lower edges of the sides of the cover 26 and the sheet extensions 33. The pads 41 may be formed of the same fabric as the cover 26 and sheet extensions 33. Alternatively, the pads may be non-stretchable flexible strips. The pads rest upon the top surface of the mattress 14 and prevent the sides of the cover and the sheet extensions from being pulled over the peripheral edge of the mattress by the straps 40. If the bed tent 10 has an open base 20 smaller than the mattress 14, the pads 41 may be eliminated and the elastic straps 40 lengthened.

The frame 28 includes a stanchion 42 disposed externally of the canopy 19 adjacent the end panel 22, and a stanchion 44 externally of the canopy adjacent the end panel 24. The stanchion 42 includes a first pair of legs 46 and 48. The stanchion 44 includes a second pair of legs 50 and 52. The frame 28 also includes a horizontal frame member 53 that extends between and is secured to the stanchions 42 and 44 and holds the stanchions erect.

Each of the legs 46, 48, 50 and 52 has a plurality of elongated, tubular leg segments 56 removably connected together end-to-end in a linear series. The connecting of the leg segments is accomplished by a sleeve 57 on one leg segment slidably receiving an end of an adjacent leg segment. The uppermost leg segment of each of the legs 46 and 48 of the stanchion 42 is removably fitted into a hole in a hollow coupling 60. The uppermost leg segment of each of the legs 50 and 52 of the stanchion 44 is removably fitted into a hole in a hollow coupling 62.

Pockets 64 are secured to the extensions 33 of the sheet 30 of each end panel 22, 24 to receive the lower ends of the legs 46, 48, 50 and 52 as more fully described hereinafter.

Clips 65 are attached to the outer surface of the sheets 30 of each end panel 22, 24 and to the top of the cover 26 for removable connection to the legs 46, 48, 50 and 52 and to the frame member 53.

The frame member 53 comprises a plurality of elongated, tubular frame member segments 68 removably connected together end-to-end in a linear series in the same manner as the leg segments 56. The segments 68 at the ends of the frame member 53 are removably fitted in holes in the respective couplings 60 and 62.

Elastic cording 69 secures the segments of the legs 46–52 and of the frame member 53 together under tension. The cording includes an elastic cord 70 which has one end attached to the lowermost tubular leg segment of the leg 46 and extends through all of the leg segments 56 of leg 46, through the hollow coupling 60, through the tubular segments 68 of the frame member 53, through the hollow coupling 62, and through the tubular leg segments 56 of the leg 50, being attached at the opposite end to the lowermost leg segment of the leg 50. The cording 69 also includes an elastic cord 72 which has one end attached to the lowermost tubular leg segment of the leg 48 and extends through all of the leg segments of the leg 48, through the hollow coupling 60, through the tubular segments 68 of the frame member 53, through the hollow coupling 62, and through the tubular segments of the leg 52, being attached at the opposite end to the lowermost leg segment of the leg 52.

The elastic cords 70 and 72 hold together under tension the segments of all of the legs 46, 48, 50 and 52, as well as the segments of the frame member 53.

The bed-tent is easily erected over the top surface of the mattress 14. This is accomplished by stretching and extending the straps 40 over the four corners of the mattress, inserting the lower ends of the legs 46, 48 of the stanchion 42 at one end of the canopy into the pockets 64 provided in the extensions 33 of the sheet 30 of the end panel 22, and inserting the lower ends of the legs 50, 52 of the stanchion 44 at the opposite end of the canopy into the pockets 64 provided in the extensions of the sheet 30 of the end panel 24, with the frame member 53 extending between the upper ends of the stanchions to hold them erect. An important feature of the invention resides in the fact that the entire frame 28, including the stanchions 40 and 42 and the interconnecting frame members 53 are disposed externally of the canopy. This makes it very easy to assemble the tent as it does not require the assembler to get inside the canopy.

The clips 65 on sheets 30 of the two end panels and on the cover 26 are snapped on the legs 46, 48, 50 and 52 and are snapped on the frame member 53 to provide a firm support for the canopy. Other conventional attachment means such as buttons, hooks, Velcro, snap-fit engagements and ties may also be used.

Figure 11:
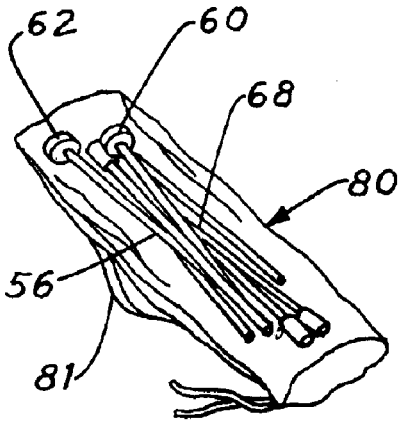
FIG. 11 is a perspective view showing the supporting frame in which the segments thereof are separated and folded and fitted into a transparent package.

The tent is just as easily taken off the mattress and stored. This is done by first unclipping the frame 28 from the canopy 19. The segments of each leg 46, 48, 50 and 52 and of the frame member 53 are separated by pulling them apart against the tension of the cords 70 and 72. The upper segments of the legs and the end segments of the frame member 53 are also separated from the couplings 60 and 62 in the same manner. All of the segments 56 and 68 are then folded together parallel to one another for storage in a package 80, for example. The package 80 is transparent and has handles 81 to provide a convenient carrying case. See FIG. 11. The separated and folded segments, of course, remain held together by the elastic cords 70 and 72.

Figure 8:
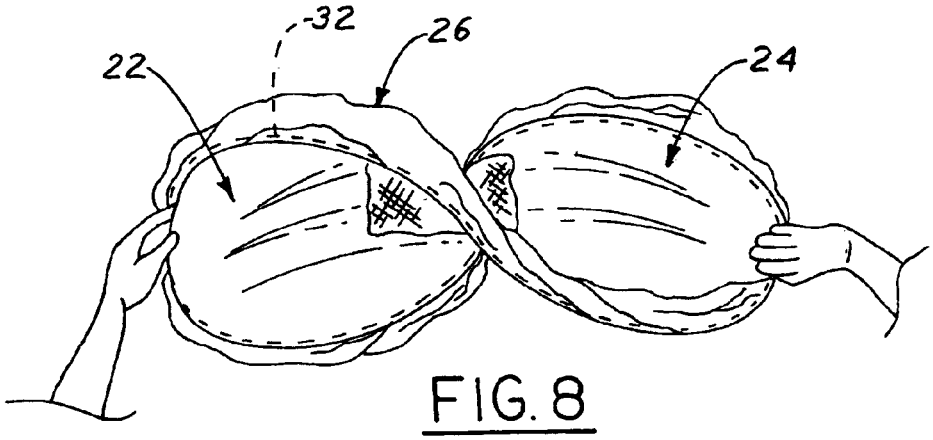
FIG. 8 is an end view showing the canopy in the process of being folded for storage.
Figure 9:
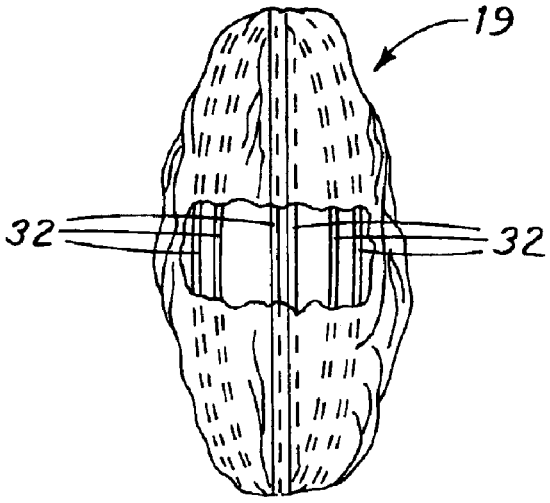
FIG. 9 is an end view showing the canopy completely folded and ready for storage.
Figure 10:
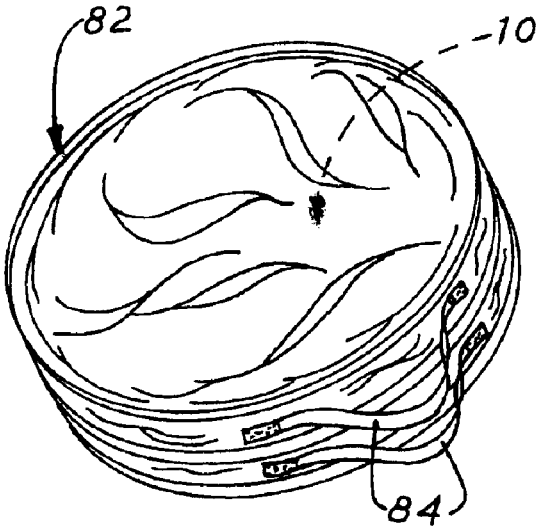
FIG. 10 is a perspective view showing the canopy folded and disposed within a transparent package.

The canopy 19 is collapsed and the hoops 32 of the end panels 22 and 24 are laid over one another and twisted (FIG. 8) or wound into a substantially flat coil of reduced diameter so that the entire canopy will fit nicely into a very small package 82 (FIG. 10) for storage. The package 82 has handles 84 and is transparent and provides a convenient carrying case.

Figure 12:
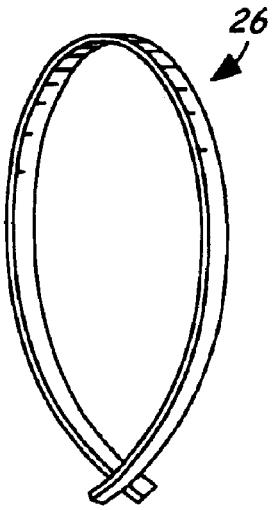
FIG. 12 is a perspective view of a transversely split hoop shown as it is initially being twisted for storage.
Figure 13:
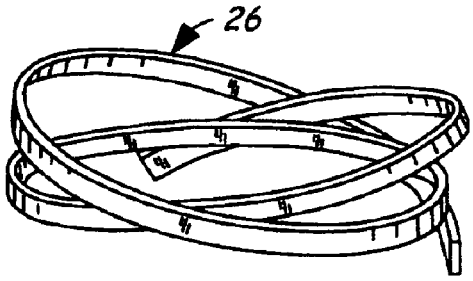
FIG. 13 is a perspective view of the hoop of FIG. 12 shown fully twisted for storage.
Figure 14:
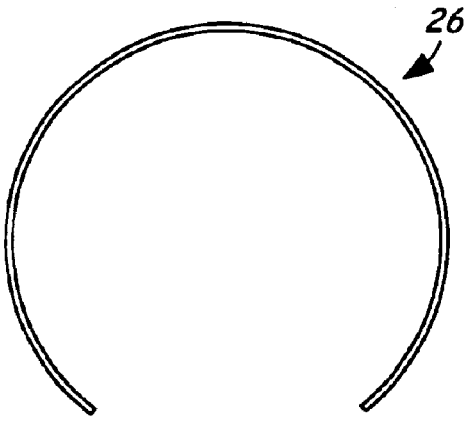
FIGS. 14–17 show a hoop in a sequence of steps by which it is wound into a flat coil of reduced diameter for storage.
Figure 15:
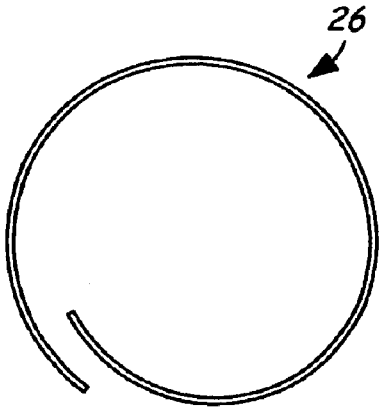
Figure 16:
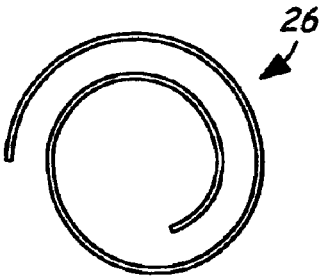
Figure 17:
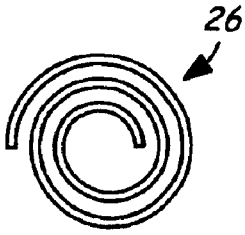

If the hoops 32 of the end panels are transversely split rather than continuous, they may be removed from the fabric through an opening provided in the stitching around the margin of the sheet material in which the hoops are received. If the hoops are not removed from the fabric stitching, the end panels will fold in a similar manner even with the hoops in place. If the hoop is open-ended to form an open arch shape panel, the ends of the hoop are first placed together before the hoop is twisted in the usual manner. FIGS. 12 and 13 illustrate how a split hoop may be twisted for storage.

FIGS. 14–17 show an alternative method of winding a split hoop for storage. Thus, the hoop may be wound into a tight spiral in a common plane to reduce its overall diameter several times for more convenient storage. Reducing a hoop to a flat coil by winding in this manner would be difficult without at least partially removing the hoop from the fabric to which it is normally attached.

Figure 18:
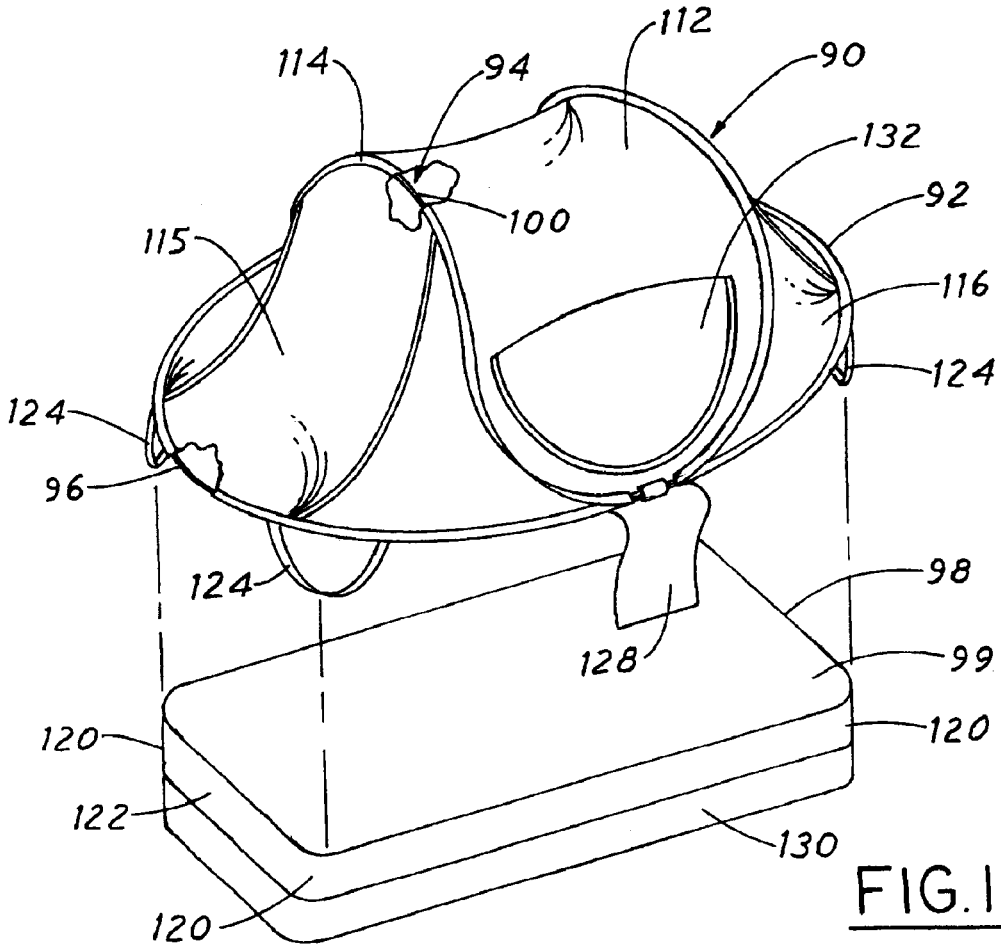
FIG. 18 is a perspective view of a bed-tent of modified construction, also according to the invention, shown positioned over a mattress prior to being mounted thereon.
Figure 19:
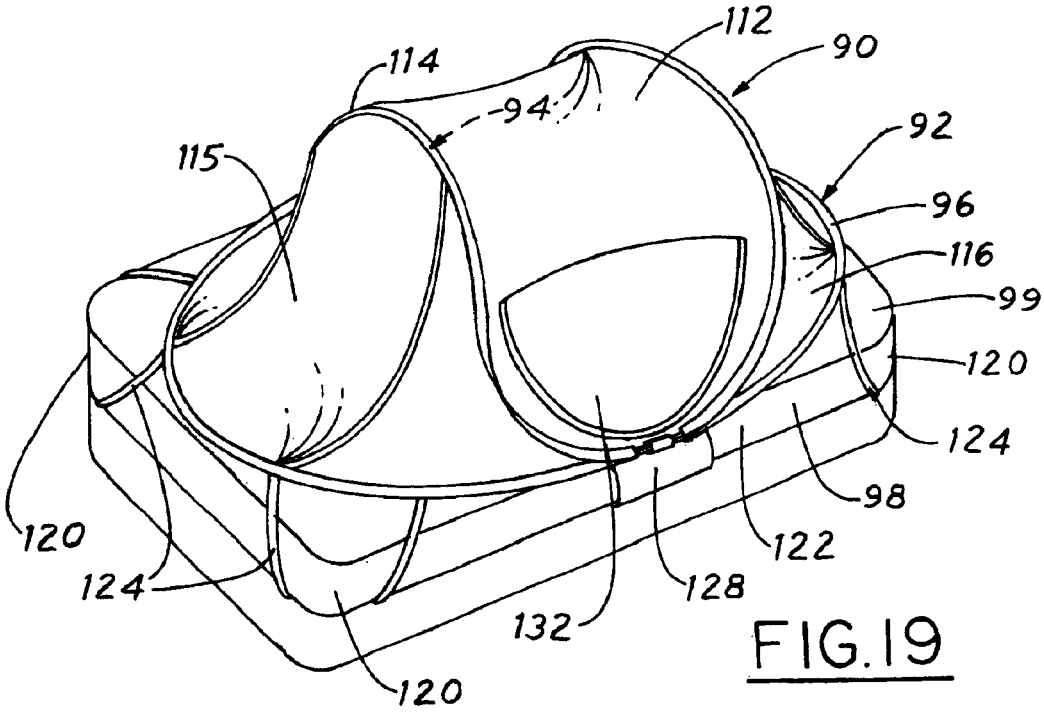
FIG. 19 is a perspective view of the bed-tent of FIG. 18 shown attached to the mattress.

FIGS. 18 and 19 are perspective views of a bed-tent 90 of modified construction. The bed-tent 90 has a base frame 92 and an upwardly arched canopy frame 94. The base frame 92 is preferably a hoop 96 of oval shape made of the same material as the hoops previously described and adapted to rest flat in a horizontal position on the top surface 99 of a rectangular mattress 98. The upwardly arched canopy frame 94 is preferably also a hoop 100 of oval shape but bent from a naturally flat condition to the upwardly arched shape shown in FIGS. 18 and 19.

Figure 20:
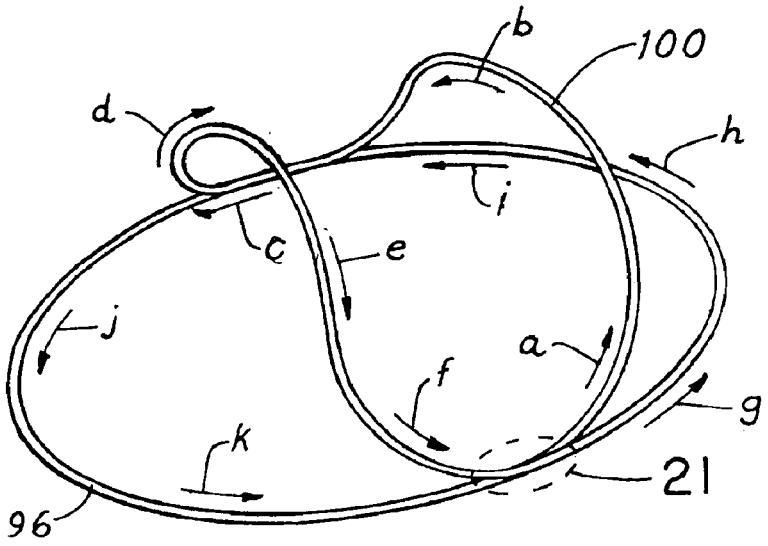
FIG. 20 is a view of a hoop employed in the bed-tent of FIGS. 18 and 19.
Figure 21:
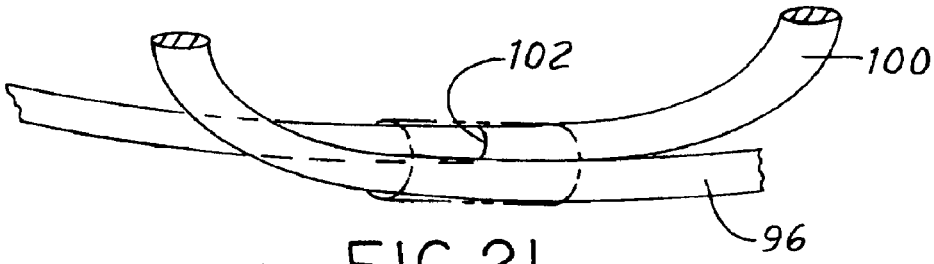
FIG. 21 is an enlarged fragmentary detail of a portion of the hoop indicated at 21 in FIG. 20.

The hoops 96 and 100 may be separately formed or they may, as here shown, be formed from one continuous length of strip material. Thus, referring to FIGS. 20 and 21, and starting at the split 102, the strip material extends up and then down into a rear end portion of the hoop 100 indicated by the arrows a and b, then along the side and front of the hoop 100 as indicated by the arrows c and d, proceeding downward as indicated by the arrows e and f where it extends into the rear portion of the base frame 96 indicated by arrows g and h, then around to the front of the base frame as indicated by the arrow J. The strip material returns to the split 102 at one side of the base frame indicated by the letter k. Thus, one strip of continuous material forms both hoops. Obviously, separate lengths of strip material may be provided if desired to make the separate hoops.

Figure 22:
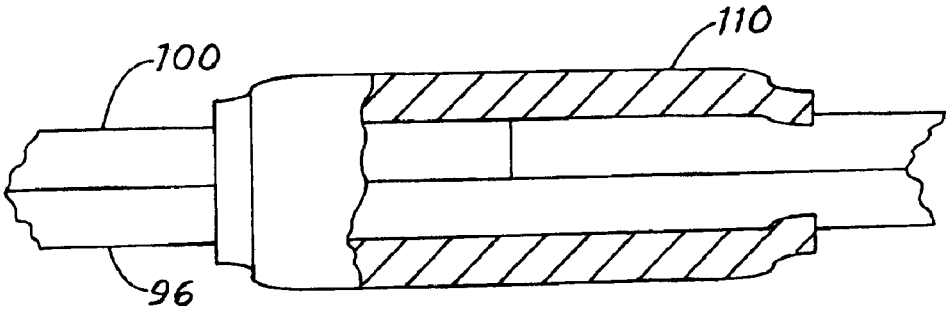
FIG. 22 is a further enlargement showing the coupling between the ends of the hoop.

The split ends of the strip material are secured together by a coupling 110 shown in FIG. 22 which preferably embraces both hoops at one side of the tent. The coupling 110 may allow the ends of the strip material to rotate with respect to each other. The two hoops at the opposite side of the tent may be secured together by any suitable means such as a similar coupling.

A sheet 112 of substantially non-stretchable fabric fills the space within the hoop 100 and is secured to hoop 100 as by a folded-over stitched margin 114 of the sheet. The arched frame 94 including the hoop 100 and the fabric sheet 112 forms the top and sides of the tent.

The front of the tent is completed by a fabric sheet 115 of non-stretchable fabric secured to the stitching along the margin of the fabric sheet 112 forming part of the arched frame 94 and also having a stitched margin to which the front and side portions of the base frame 92 is secured. A similar fabric sheet of non-stretchable fabric 116 is stitched in a similar manner both to the base frame 92 and to the arched frame 94 to complete the canopy enclosure.

FIG. 19 shows the bed-tent 90 secured to the corners 120 of the rectangular mattress 98 by straps 124 as of elastic or the like secured to the edges of the fabric sheets 115 and 116. The bed-tent preferably extends over substantially the entire top surface 99 of the mattress. A flap 128 of fabric material secured to the side edges of the sheets 115 and 116 at one side of the bed-tent may be adapted to be tucked between the mattress 98 and box-spring 130 supporting the mattress. A similar flap (not shown) may be provided on the opposite side of the bed-tent. The flaps may be releasably attached to each other under the mattress. The sheet 112 has a cut-away portion providing a panel 132 which may be folded back for access to the interior of the bed-tent.

Figure 23:
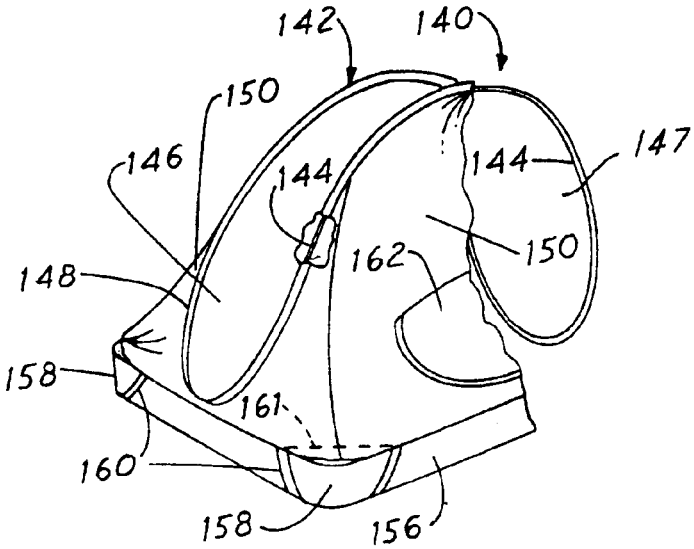
FIG. 23 is a perspective view of a bed-tent according to further modification.
Figure 24:
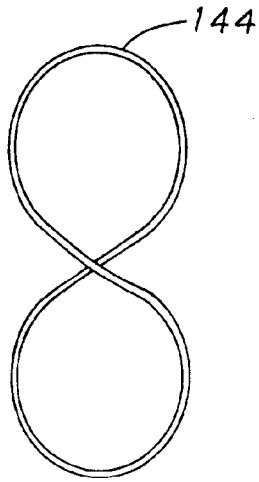
FIG. 24 is a top view of the twisted hoop employed in the embodiment of FIG. 23.

FIG. 23 is a perspective view of a bed-tent 140 of a further modification. The bed-tent 140 has a canopy frame 142 in the form of an endless hoop 144 of the same material as previously described. The hoop 144 is twisted into the shape of the numeral 8 (FIG. 24) and is bent from a naturally flat condition to an upwardly arched shape as shown. Sheets 146 and 147 of substantially non-stretchable fabric fill the space within the twisted loops of the hoop 144 and are secured to the hoop 144 as by folded-over stitched margins 148 of the sheets. The arched frame 142 including the hoop 144 and fabric sheets 146 and 147 form the front, top and rear of the tent.

Sheets 150 of substantially non-stretchable fabric at the front, sides and rear of the tent extend downwardly from the arched frame to the bottom of the tent, being secured as by stitching to the marginal edge portions of the sheets 146 and 147 of the arched frame. The lower edges of the canopy sheets 150 are adapted to extend down to the upper surface of a rectangular mattress 156 and may be held in place along the sides by flaps 154 secured to the side portions of the sheet and adapted to be tucked under the mattress 156 between the mattress and a supporting box spring (not shown).

The bed-tent 140 is secured to the corners 158 of the rectangular mattress 156 by straps 160 secured to the corner portions of the fabric sheets. The bed-tent preferably extends over substantially the entire top surface of the mattress. The four corners of the bed-tent preferably have pads 161 secured to the lower edges of the sheets 150. These pads 161 are like the pads 41 previously described and serve the same purpose. If the bed tent 140 is smaller than substantially the entire top surface of the mattress, straps 160 are lengthened and pads 161 can be eliminated. The sheet on one side of the bed-tent has a cutaway portion providing a panel 162 which may be folded back for access to the interior of the bed-tent.

Figure 25:
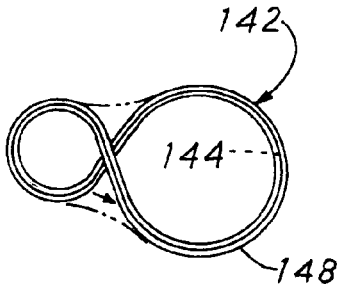
FIG. 25 is a view of the hoop employed in FIG. 23, shown untwisted and within a stitched margin of fabric material, but omitting the fabric material of the bed-tent.
Figure 26:
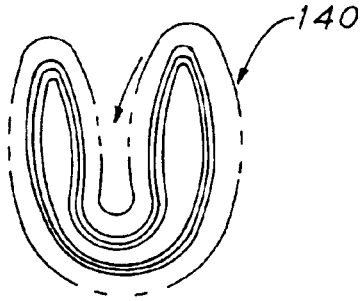
FIGS. 26–28 show the bed-tent of FIG. 23 being folded and finally packaged.
Figure 27:
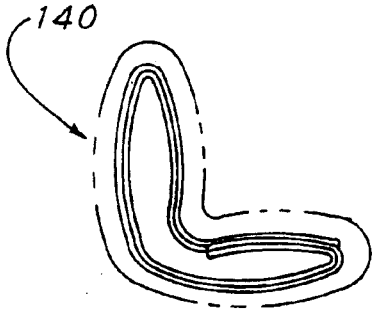
Figure 28:
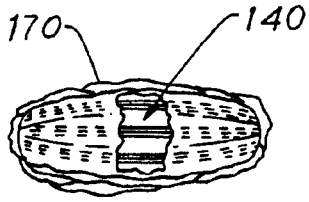

FIG. 25 shows the hoop 144 untwisted, with the fabric excluded. FIGS. 26–27 show a sequence of positions as the bed-tent 140 is folded to a more or less flat condition enabling it to be placed within a package 170 for storage as shown in FIG. 28.

What is claimed is:

1. A bed-tent for providing an enclosure over a bed, comprising:

a canopy having an open base, said canopy comprising spaced apart at least first and second panels and a flexible cover extending between said panels, each said panel comprising at least one hoop of flexible, resilient, strip material and a sheet of flexible fabric in the space within and marginally secured to said hoop generally at the perimeter thereof, said sheets being maintained taut by, and resisting collapse of, the hoops to which said sheets are secured, retainers for releasably securing said canopy to the bed, and an entry to said canopy, at least one of said hoops being capable of being twisted or wound into a relatively flat coil of reduced diameter for storage, a mattress for the bed, the mattress having a top surface, a peripheral edge, and four corners, the open base of the canopy being substantially coextensive with the peripheral edge of the mattress, and the retainers releasably engaging the mattress, wherein said retainers comprise flexible straps respectively engaging the corners of the mattress.

2. A bed-tent for providing an enclosure over a bed mattress, comprising:

a canopy having an open base, said canopy comprising spaced apart at least a first panel and a second panel and a flexible cover extending between said panels, a flexible supporting frame disposed externally of said canopy for holding said panels spaced apart and generally erect, connectors to releasably attach said canopy to said frame, receiving means on said canopy for removably receiving end portions of said frame, retainers for releasably securing said canopy to the bed mattress, and an entry to said canopy, said frame having a first flexible stanchion releasably connected to said first panel, said frame having a second flexible stanchion releasably connected to said second panel, said frame having a frame member disposed above said canopy and extending between and holding generally upright said first and second stanchions.

3. The bed-tent of claim 2, wherein said stanchions and said frame member each comprise a plurality of elongated tubular segments removably connected end-to-end in a linear series.

4. The bed-tent of claim 3, wherein said tubular segments are held together by elastic cording under tension extending lengthwise through said segments.

5. A bed-tent for providing an enclosure over bed mattress, comprising:

a canopy having an open base, said canopy comprising spaced apart at least a first panel and a second panel and a flexible cover extending between said panels, a flexible supporting frame disposed externally of said canopy for holding said panels spaced apart and generally erect, connectors to releasably attach said canopy to said frame, receiving means on said canopy for removably receiving end portions of said frame, retainers for releasably securing said canopy to the bed mattress, and an entry to said canopy, wherein said retainers comprise flexible straps respectively engaging the corners of the mattress.

6. A bed-tent for providing an enclosure over a bed mattress, comprising:

a canopy having an open base, said canopy comprising spaced apart at least a first panel and a second panel and a flexible cover extending between said panels, a flexible supporting frame disposed externally of said canopy for holding said panels spaced apart and generally erect, connectors to releasably attach said canopy to said frame, receiving means on said canopy for removably receiving end portions of said frame, retainers for releasably securing said canopy to the bed mattress, and an entry to said canopy, wherein at least one of said panels includes at least one hoop of flexible, resilient material encircling and secured to a fabric sheet at most points thereof, said hoop supporting said sheet and said sheet resisting collapse of said hoop, wherein said frame comprises a plurality of elongated, tubular segments removably connected end-to-end in a linear series, further including a mattress for the bed, the mattress having a top surface, a peripheral edge, and four corners, the open base of the canopy being generally coextensive with the peripheral edge of the mattress, and the retainers releasably engaging the mattress, wherein said hoop is continuous except for a transverse open split.

7. The bed tent of claim 6 wherein at least one of said at least one hoop is capable of being twisted or wound into a relatively flat coil.

8. The bed tent of claim 6 wherein said frame includes a horizontal frame member.

9. The bed tent of claim 8 wherein said frame further includes at least one stanchion.

10. In combination, a bed-tent for a bed, a bed mattress having a top surface, a peripheral edge, and four corners, a canopy having an open base at least partially coextensive with the peripheral edge of the mattress, said canopy including at least one panel having at least one hoop of flexible, resilient strip material and a sheet of flexible fabric in the space within and marginally secured to the hoop generally at the perimeter thereof, said hoop being capable of being twisted or wound into a relatively flat coil of reduced diameter for storage, retainers for releasably securing the canopy to the mattress, and an entry to said canopy, wherein said retainers include flexible straps respectively engaging the four corners of the mattress.

11. The combination of claim 10, further including support means to maintain said canopy on said top surface of said mattress.

12. The combination of claim 11, wherein said canopy includes a second hoop of flexible, resilient strip material defining the base of the canopy.

13. The combination of claim 12, wherein said one hoop and said second hoop are portions of one continuous flexible strip.

14. The combination of claim 10, further including at least a second panel having a second hoop of flexible resilient material and a second sheet of flexible fabric in the space within and marginally secured to said second hoop generally at the perimeter thereof.

15. The combination of claim 14, wherein said hoop and said second hoop are portions of one continuous flexible strip.

16. The combination of claim 14, wherein said hoop is adapted to be secured to said second hoop along a limited periphery thereof.

17. The combination of claim 14, wherein said panels define a cover section of said canopy at least a portion of which is upwardly inclined from the base of the canopy.

18. The combination of claim 14, wherein said panels define a cover section of said canopy at least a portion of which is downwardly inclined towards the base of the canopy.

19. The combination of claim 14, further including a supporting frame releasably connected to said canopy for holding said panels spaced apart and generally erect.

20. The combination of claim 19, further including receiving means on said canopy for removably receiving end portions of said frame.

21. A bed-tent for providing an enclosure over a bed having a mattress with a top surface, a peripheral edge, and four corners, the bed tent comprising:

a canopy having an open base, said canopy comprising spaced apart at least first and second panels and a flexible cover extending between said panels, each said panel comprising at least one hoop of flexible, resilient, strip material and a sheet of flexible fabric in the space within and marginally secured to said hoop generally at the perimeter thereof, said sheets being maintained taut by, and resisting collapse of, the hoops to which said sheets are secured, at least one retainer for releasably securing said canopy to the bed, and an entry to said canopy, the open base of the canopy being substantially coextensive with the peripheral edge of the mattress, and wherein said at least one retainer releasably engages at least a side surface portion of at least one corner of the mattress.

22. The bed tent of claim 21 wherein at least one of said at least one hoop is capable of being twisted or wound into a relatively flat coil.

23. A bed-tent for providing an enclosure over a bed mattress, comprising:

a canopy having an open base, said canopy comprising spaced apart at least a first panel and a second panel and a flexible cover extending between said panels, a flexible supporting frame disposed externally of said canopy for holding said panels spaced apart and generally erect, connectors to releasably attach said canopy to said frame, retainers for releasably securing said canopy to the bed mattress, and an entry to said canopy the open base of the canopy being substantially coextensive with the peripheral edge of the mattress, said frame having a first flexible stanchion releasably connected to said first panel, said frame having a second flexible stanchion releasably connected to said second panel, said frame having a frame member disposed above said canopy and extending between and holding generally upright said first and second stanchions.

24. A bed-tent for providing an enclosure over a bed mattress, comprising:

a canopy having an open base, said canopy comprising spaced apart at least a first panel and a second panel and a flexible cover extending between said panels, a flexible supporting frame disposed externally of said canopy for holding said panels spaced apart and generally erect, connectors to releasably attach said canopy to said frame, at least one retainer for releasably securing said canopy to the bed mattress, and an entry to said canopy, wherein said at least one retainer releasably engages at least a side surface portion of at least one corner of the mattress.

25. In combination, a bed-tent for a bed, a bed mattress having a top surface, a peripheral edge, and four corners, a canopy having an open base at least partially coextensive with the peripheral edge of the mattress, said canopy including at least one panel having at least one hoop of flexible, resilient strip material and a sheet of flexible fabric in the space within and marginally secured to the hoop generally at the perimeter thereof, at least one retainer for releasably securing the canopy to the mattress, and an entry to said canopy, wherein said at least one retainer releasably engages at least a side surface portion of at least one corner of the mattress.

26. The combination of claim 25 wherein at least one of said at least one hoop is capable of being twisted or wound into a relatively flat coil.

27. The combination of claim 25 wherein said at least one retainer includes a pocket that receives at least a portion of a corner of the mattress.

28. The combination of claim 25 wherein said at least one retainer includes a flexible strap or band.

* * * * *

UNITED STATES PATENT AND TRADEMARK OFFICE

CERTIFICATE OF CORRECTION

PATENT NO. : 6,952,844 B2
APPLICATION NO. : 10/649036
DATED : October 11, 2005
INVENTOR(S) : Thomas C. Danaher It is certified that error appears in the above-identified patent and that said Letters Patent is hereby corrected as shown below:

In the Claims:

Claim 25, Column 14, Line 37, after "a bed tent for a bed" insert --comprising--

Signed and Sealed this

Fifteenth Day of August, 2006

JON W. DUDAS
*Director of the United States Patent and Trademark Office*